US006324726B1

(12) United States Patent
Hörmann

(10) Patent No.: US 6,324,726 B1
(45) Date of Patent: Dec. 4, 2001

(54) GUIDE RUNNER FOR DOOR DRIVE MECHANISM

(75) Inventor: Michael Hörmann, Halle (DE)

(73) Assignee: Marantec Antriebs-und Steuerungstechnik GmbH & Co. KG, Marienfeld (DE)

( * ) Notice: Subject to any disclaimer, the term of this patent is extended or adjusted under 35 U.S.C. 154(b) by 0 days.

(21) Appl. No.: 09/403,117

(22) PCT Filed: Mar. 23, 1998

(86) PCT No.: PCT/EP98/01676

§ 371 Date: Dec. 14, 1999

§ 102(e) Date: Dec. 14, 1999

(87) PCT Pub. No.: WO98/46848

PCT Pub. Date: Oct. 22, 1998

(30) Foreign Application Priority Data

Apr. 16, 1997 (DE) ..... 297 06 904 U

(51) Int. Cl.[7] ..... E05D 15/00

(52) U.S. Cl. ..... 16/93 R; 16/87

(58) Field of Search ..... 16/93 R, 101, 16/106, 86.2; 49/279, 280, 281, 282, 291, 293, 139, 140, 197, 449, 319, 394, 395, 360, 19 D, 302, 307, 199, 200, 176, 181, 445, 446; 292/DIG. 36, 33, 36, 144; 310/12–19; 74/424.8, 625

(56) References Cited

U.S. PATENT DOCUMENTS

| | | | | |
|---|---|---|---|---|
| 1,357,407 | * | 11/1920 | Lang | 49/199 |
| 5,222,403 | | 6/1993 | Angelini et al. | 74/89.21 |

FOREIGN PATENT DOCUMENTS

| | | | | |
|---|---|---|---|---|
| 8506669.96 | | 8/1985 | (DE) | 49/31 |
| 35 08 174-A1 | * | 11/1986 | (DE) | 49/197 |
| 8710940.6 | | 12/1987 | (DE) | 49/197 |
| 299 489-A1 | * | 1/1989 | (DE) | 49/349 |
| 37 26 685-A1 | * | 2/1989 | (DE) | 49/31 |
| 299 489-A1 | * | 1/1989 | (EP) | 49/349 |
| 405-248139-A | * | 9/1993 | (JP) | 49/349 |

* cited by examiner

*Primary Examiner*—Anthony Knight
*Assistant Examiner*—Ruth C. Rodriguez
(74) *Attorney, Agent, or Firm*—Dilworth & Barrese, LLP

(57) ABSTRACT

The invention relates to a guide skid for a gate drive which is accommodated sliding in a C-profile, with two lateral openings extending over its length to accommodate a drive cord, a locking element for the coupling and disconnecting from the drive cord and a connecting element for the gate to be moved. The guide skid has a symmetrical outline and when installed has no parts projecting beyond the C-profile, and with the guide skid being provided one face thereof with a continuous slot which is bridged by a bolt forming the connecting element.

17 Claims, 5 Drawing Sheets

GUIDE RUNNER FOR DOOR DRIVE MECHANISM

BACKGROUND OF THE INVENTION

The invention relates to a guide skid for a gate drive which is accommodated sliding in a C-profile, with two lateral openings extending over its length to accommodate a drive cord, with a locking element for the coupling to and disconnecting from the drive cord and with a connecting element for the gate to be moved.

With known gate drives the guide skids are accommodated sliding in a C-profile. They have two lateral openings extending over their length to accommodate a drive cord, e.g. a drive chain or drive belt. By means of an insertable locking element the guide skids can be coupled to the drive chain or drive belt, and when required can be disconnected from same by means of a handle. When installed, a fastening eye projects from the underside of the guide skid downwards beyond the delimiting surface of the C-profile. An actuating rod for the gate is attached to this fastening eye. This asymmetrical construction of the guide skid has several disadvantages. Thus, because of the asymmetrical construction, the handling of the guide skids during storage and transport is inconvenient. From the strength point of view, the projecting fastening eye furthermore constitutes a critical component.

SUMMARY OF THE INVENTION

It is the object of the invention to improve the guide skid of the indicated type in such a way that it has a compact construction and, whilst made of comparatively few parts, reliably performs all functions. According to the invention this objective is achieved, proceeding from a guide skid which is accommodated sliding in a C-profile, with two lateral openings extending over its length to accommodate a drive cord, with a locking element for the coupling to and disconnecting from the drive cord and with a connecting element for the gate to be moved, by the features of the guide skid having a symmetrical outline and when installed has no parts projecting past the C-profile, and with the guide skid being provided on one face thereof with a continuous slot which is bridged by a bolt which forms the connecting element. According to same, the guide skid has a symmetrical outline and when installed has no parts projecting beyond the C-profile. In addition, the guide skid is provided on one face with a continuous slot which extends parallel to the side walls. The slot is bridged by a bolt which forms the connecting element. The bolt is, therefore, securely anchored in the housing of the guide skid, which increases the stability of the fastening point formed by the bolt.

According to the preferred embodiment, the bolt can be put from the outside into a slot in the form of a U-profile and can be fixed into position at its ends by fastening screws. As a result, it will be easy to put in the bolt when the guide skid is already installed in the C-profile.

Preferably, the skid consists essentially of two moulded plastic parts which can be plugged onto one another and joined together in a detachable manner.

The locking element arranged inside the skid consists of a shiftable locking bar which is arranged moving transversely to the direction of movement of the guide skid. Preferably, a guide lug is arranged, e.g. moulded onto the locking bar, which co-operates with a slide guide provided on a spring-loaded shifting element arranged movable in the guide skid. The slide guide of the shifting element can be actuated against the force of the spring by means of a handle in order to couple and disconnect the locking bar. The handle can be guided out of the slot in the middle of the guide skid. It can, therefore, be moved downwards out of the slot in any installation position of the guide skid.

To ensure an accurate adaptation to various heights of the C-profile, at least part of the surface of the guide skid can be covered by an adapter which is fastened to the guide skid in a detachable manner. Separate protection is claimed for this problem solution.

BRIEF DESCRIPTION OF THE DRAWINGS

Further details, characteristics and advantages of the invention will be explained in more detail with reference to an exemplified embodiment illustrated in the drawings, wherein.

DESCRIPTION OF THE PREFERRED EMBODIMENTS

Figure 2:
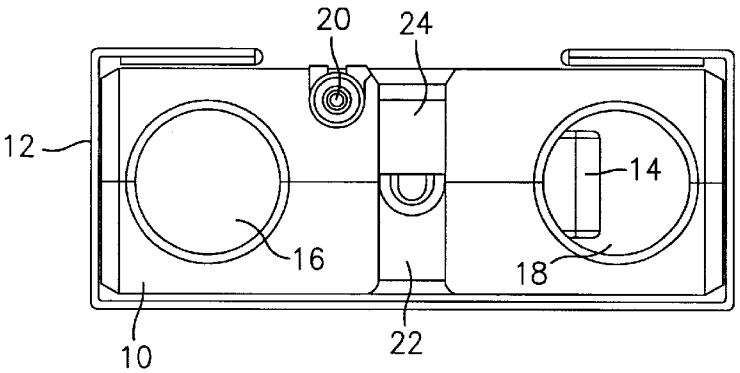
FIG. 2: shows a section through the guide skid of FIG. 1, FIG. 3: shows a perspective view of an embodiment of the guide skid which has been slightly modified compared to FIG. 1, FIG. 4: shows an exploded view of a guide skid according to FIG. 1 dismantled into its parts.
Figure 1:
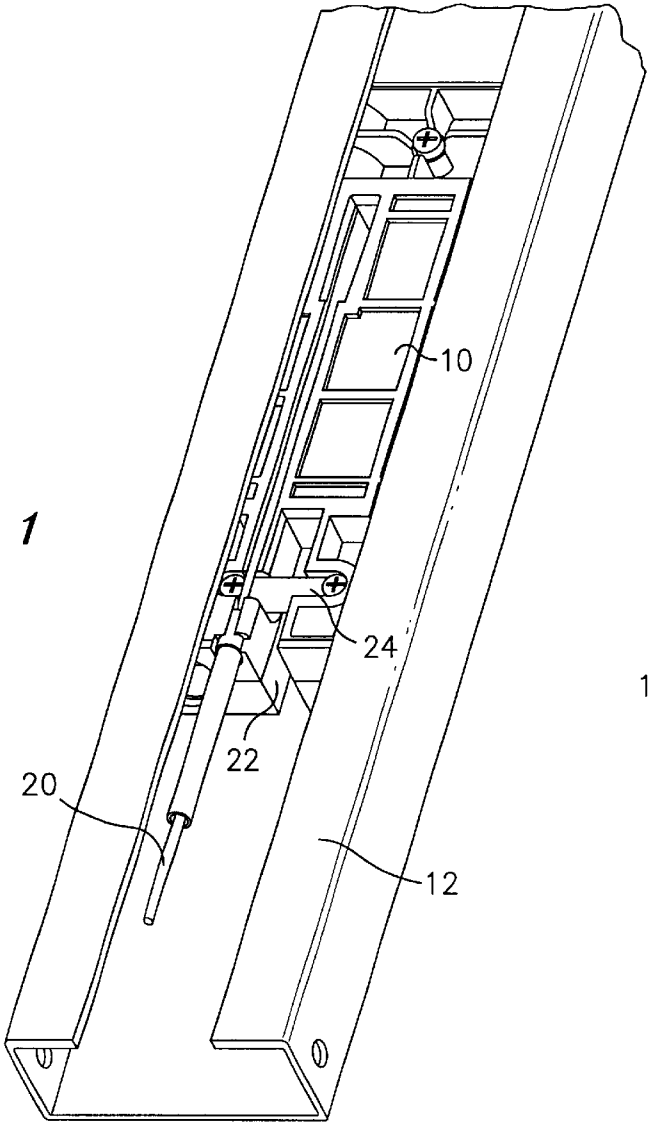
FIG. 1: shows a perspective view of a guide skid according to one embodiment of the present invention in the installed state.

FIGS. 1 and 2 show a guide skid 10 according to the invention, which is guided sliding in a C-rail profile 12. Guided in the lateral sections of the C-rail profile 12 is, for example, a toothed belt—not illustrated—which can be driven by way of a drive motor which is not illustrated here. The guide skid 10 can be coupled to this toothed belt by way of a locking bar 14, which is illustrated diagrammatically in FIG. 2. The toothed belt runs through the lateral openings 16 and 18 provided over the length of the guide skid 10. By pushing the locking bar 14 into the opening 18, the guide skid 10 is coupled to the toothed belt—not illustrated—and by a corresponding pulling back of the locking bar 14 the guide skid 10 is disconnected from the toothed belt. The coupling movement takes place by means of a handle 20, which in an exemplified arrangement can be noted from the illustrations of FIGS. 1 and 2. In this embodiment the handle is arranged asymmetrically.

The guide skid 10 is provided in the middle on one face with a slot 22. This slot is bridged by a laterally fastened bolt 24. A connecting rod for the gate to be moved—not illustrated—can be attached by way of the bolt 24. According to another, not illustrated embodiment the handle 20 may also be arranged in the area of the slot 22. This has the advantage that the handle 20, depending on the installation position of the skid 10, can be moved downwards out of the C-rail profile 12 from each of the two installation positions turned by 180°.

Figure 3:
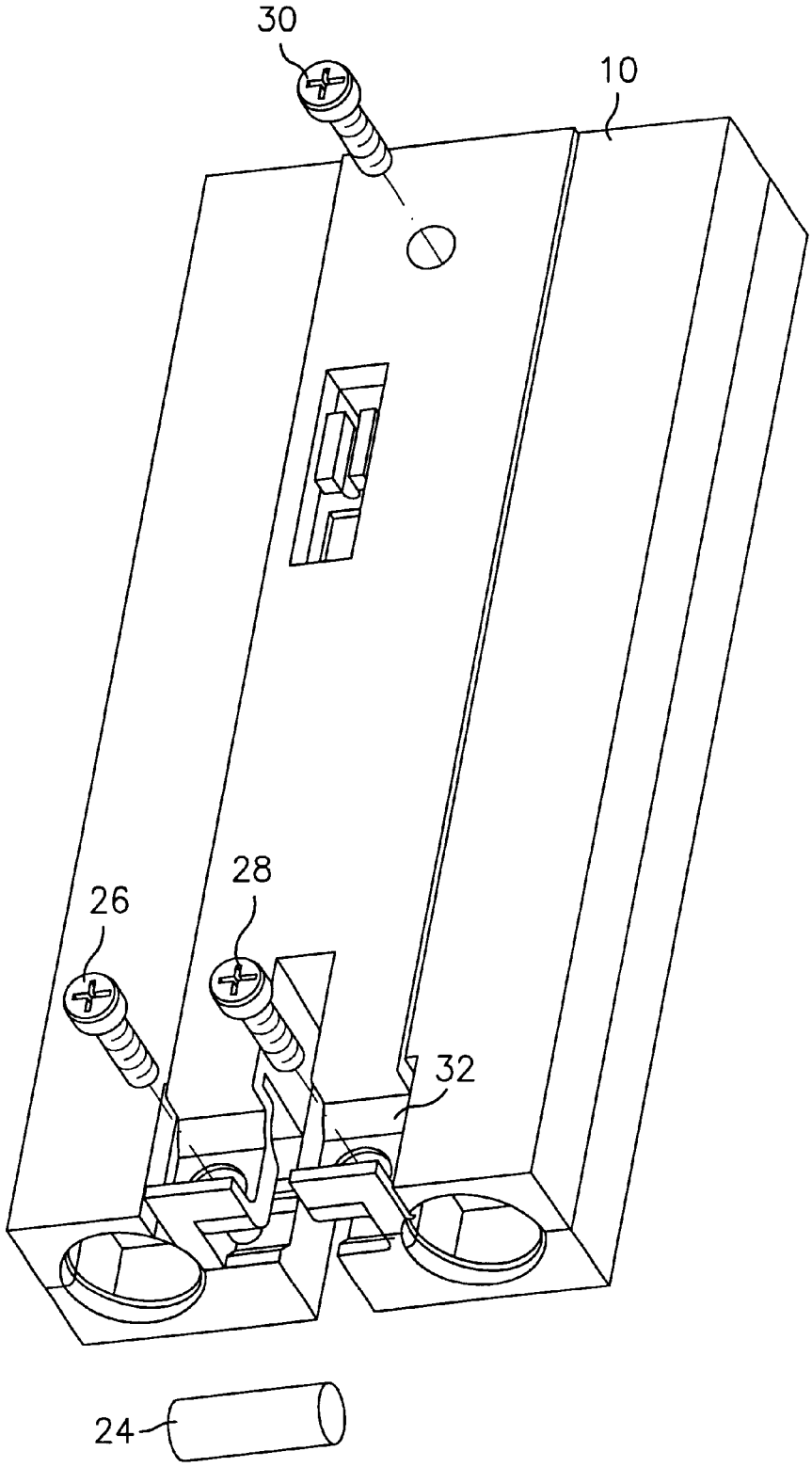

FIG. 3 shows how the bolt 24 is fastened in the guide skid 10. The guide skid 10 is provided with slot-like recesses in the form of a U-profile 32, into which the bolt 24 can be placed and held in position by means of screws 26 and 28.

Figure 4:
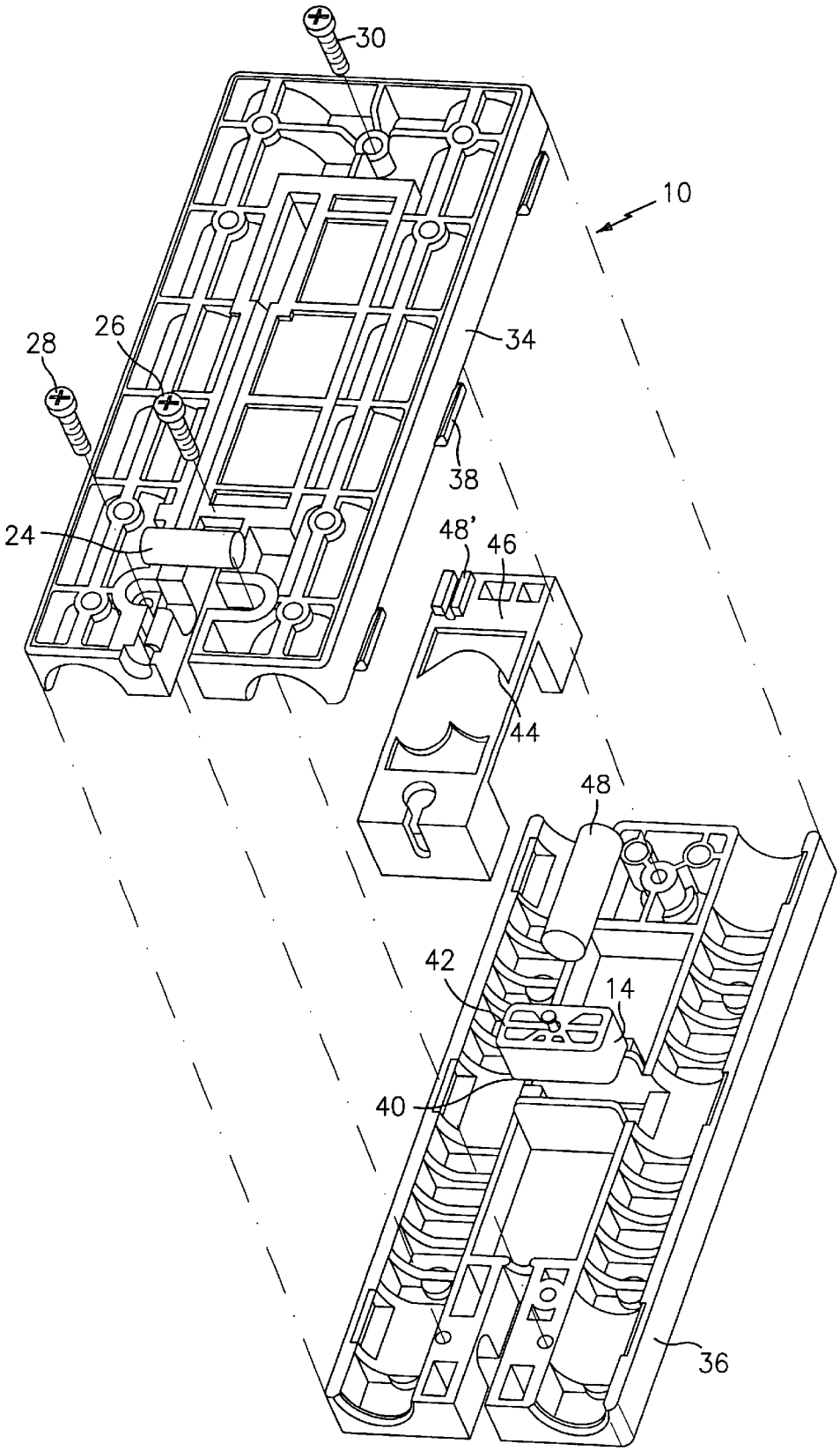
Figure 5:
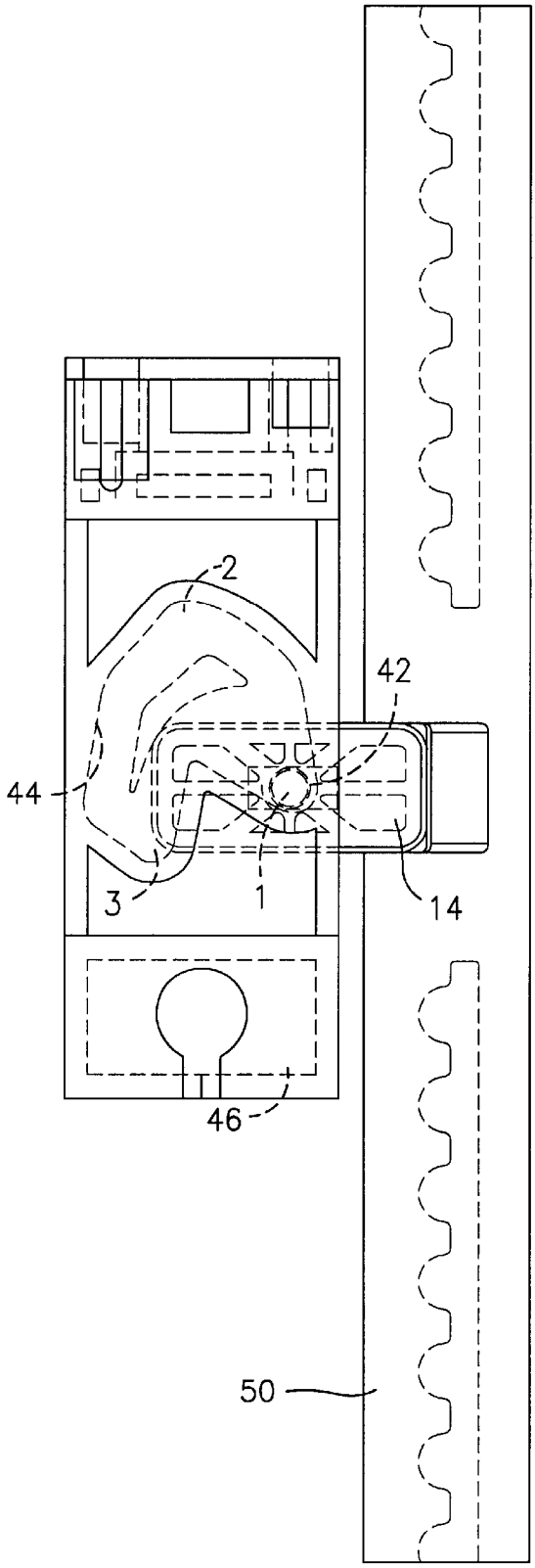
FIG. 5: shows a top view onto a guide skid in basic representation to explain the locking mechanism.

As can be noted in particular from FIG. 4, the guide skid 10 with its symmetrical outline consists essentially of two molded plastic parts 34 and 36 that can be plugged onto one another and joined together in a detachable manner. The plugging together of the two half—shells 34 and 36 takes place by lateral snap-in lugs 38, which permit an easy joining together by snapping in. For securing purposes, connecting screws 26, 28 and 30 are provided wherein the connecting screws 26,28 at the same time serve to hold the bolt 24 in position, as indicated in the foregoing. In the bottom molded plastic part 36 of the skid 10, a guide 40 is integrated for the locking bar 14 which forms a separate molded plastic part. This guide consists essentially of two parallel ends, between which the locking bar 14 is guided shifting lengthways. The direction of movement of the locking bar 14 extends at 90° to the direction of movement of the guide skid 10. At the top a guide lug 42 is molded onto the locking bar 14. This guide lug 42 co-operates with a slide guide 44 which is provided on a shifting element 46. The shifting element 46 is mounted shifting lengthways in the guide skid 10 and rests against a compression spring which holds the shifting element in a starting position. The shifting element 46 can be shifted against the force of the compression spring 48 by means of the handle 20, which engages in the attachment 48' on the shifting element. By this lengthways shifting of the shifting element 46, by way of the guide lug 42, the position of the locking bar 14 is changed. This will be explained with reference to FIG. 5. There the locking bar 14 is illustrated in the position in which it is coupled to a toothed belt connector 50. In this position the guide lug 42 of the locking bar 14 lies in position 1 of the slide guide 44. To release the locking bar 14, the shifting element 46 is shifted until the guide lug 42 of the locking bar 14 has reached the apex 2 of the slide guide 44. After releasing the handle, the shifting element 46 is moved by the spring pressure in the direction opposite to the pulling direction of the handle, so that the guide lug 42 together with the locking bolt 14 is moved along the curve of the slide guide into position 3. In this position the locking bar 14 is pulled laterally along the guide 40 of FIG. 4 inwards into the guide skid 10, so that the released position is obtained. To produce a locking, the shifting element 46 is again moved downwards by means of the handle. Via the slide guide 44 the locking bar is then again moved into the starting position 1, so that it is again moved into the locked position.

Figure 6:
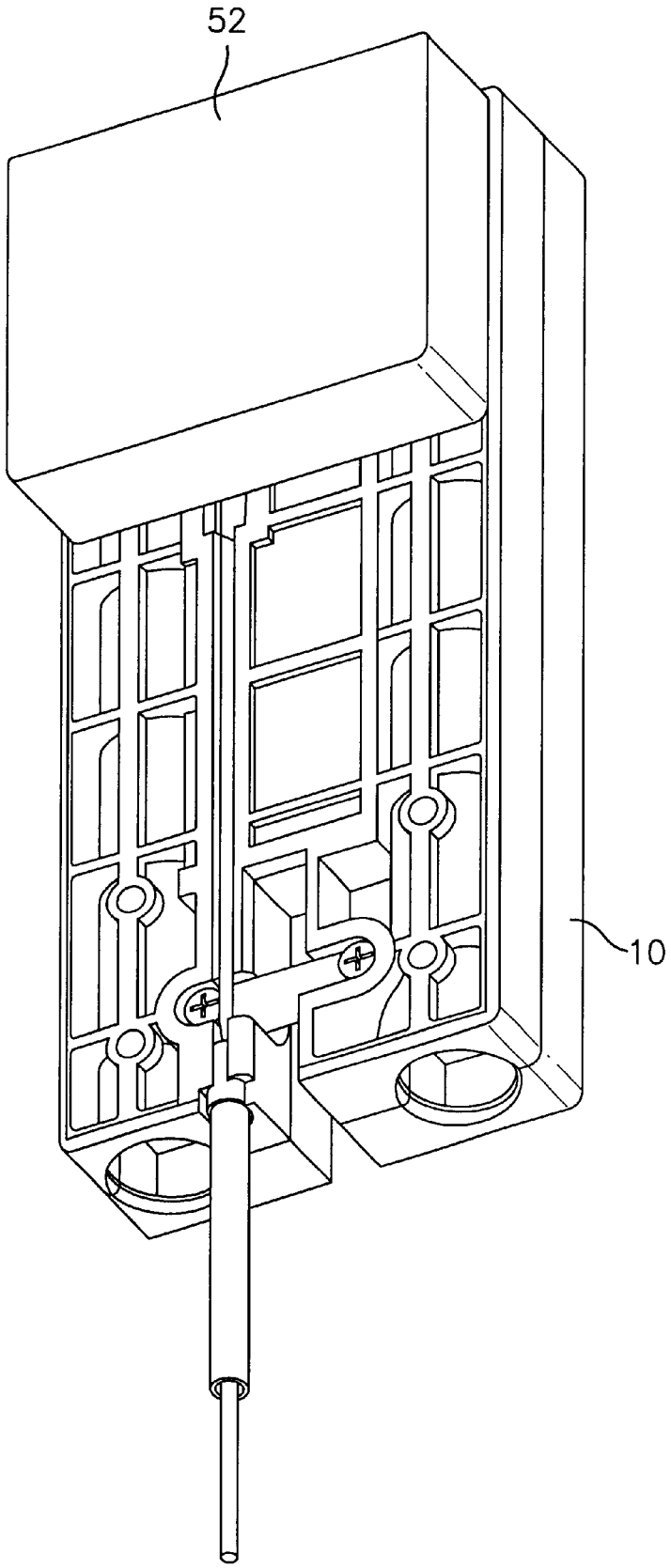
FIG. 6: is a perspective view of a guide skid according to FIG. 1 with attached adapter.

In the embodiment according to FIG. 6, the guide skid described in the foregoing is screwed to an adapter 52 which covers part of it. The adapter 52 is a moulded plastic part which extends over the entire width of the guide skid 10 and is sufficiently long to ensure a secure guiding in a C-profile. By suitably thick adapters 52 an adaptation to the height of the C-rail can take place.

What is claimed is:

1. Guide skid for a gate drive, which is structured and arranged to be accomodated sliding in a C-profile, with two-lateral openings extending over its length to accomodate a drive cord, a locking element for coupling to and disconnecting from the drive cord and a connecting element for the gate to be moved, wherein the guide skid has symmetrical outline and when installed in the C-profile, is structured and arranged such that all parts of the guide skid are contained within the C-profile and no parts thereof project beyond a slot in the C-profile, the guide skid is provided on one face with a continous slot which is bridged bya bolt which forms the connecting element, and the bolt can be put, from outside, into a U-profile and can be fixed into position at its ends by fastening screws.

2. Guide skid according to claim 1, wherein the locking element consists of a shiftable locking bar which is arranged moving transversely to direction of movement of the guide skid.

3. Guide skid according to claim 2, wherein an adapter which covers at least part of the guide skid and is fastened to the guide skid in a detachable manner in order to adapt it to different C-rail heights.

4. Guide skid according to claim 1, wherein the skid consists essentially of two molded plastic parts which can be plugged onto one another and joined together in a detachable manner.

5. Guide skid according to claim 4, wherein the locking element consists of a shiftable locking bar which arranged moving transversely to the direction of movement of the guide skid.

6. Guide skid according to claim 1, wherein an adapter which covers at least part of the guide skid and is fastened to the guide skid in a detachable manner in order to adapt it to different C-rail heights.

7. Guide skid for a gate drive, which is structured and arranged to be accomodated sliding in a C-profile, with two lateral openings extending over its length to accomodate a drive cord, a locking element for coupling to and disconnecting from the drive cord, and a connecting element for the gate to be moved, wherein the guide skid has a symmetrical outline and when installed in the C-profile, is structured and arranged such that all parts of the guide skid are contained within the C-profile and no parts thereof projet beyond a slot in the C-profile, the guide skid is provided in face with a continous slot which is bridged by a bolt which forms the connecting element, and the skid consists essentially of two molded plastic parts which can be plugged onto one another and joined together in a detachable manner.

8. Guide skid according to claim 7, wherein the locking element consists of a shiftable locking bar which arranged moving transversely to the direction of movement of the guide skid.

9. Guide skid according to claim 7, wherein an adapter which covers at least part of the guide skid and is fastened to the guide skid in a detachable manner in order to adapt it to different C-rail heights.

10. Guide skid for a gate drive, which is structured and arranged to be accommodated sliding in a C-profile, with two lateral openings extending over its length to accommodate a drive cord, a locking element for the coupling to and disconnecting from the drive cord and a connecting element for the gate to be moved, wherein the guide skid has a symmetrical outline and when installed in the C-profile, is structured and arranged such that all parts of the sliding guide skid are contained within the C-profile and no parts thereof project beyond a slot in the C-profile, the guide skid is provided on one face with a continuous slot which is bridged by a bolt which forms the connecting element, the locking element consists of a shiftable locking bar which is arranged moving transversely to the direction of movement of the guide skid, and a guide lug is arranged on the locking bar, which co-operates with a slide guide provided on a spring-loaded shifting element.

11. Guide skid according to claim 10, wherein the slide guide of the shifting element can be actuated against the force of the spring by means of a handle in order to couple and disconnect the locking bar.

12. Guide skid according to claim 11, wherein the handle is guided out of the slot in the middle of the guide skid, so that it can be moved downwards out of the slot in any installation position of the guide skid.

13. Guide skid according to claim 12, wherein an adapter which covers at least part of the guide skid and is fastened to the guide skid in a detachable manner in order to adapt it to different C-rail heights.

14. Guide skid according to claim 11, wherein an adapter which covers at least part of the guide skid and is fastened to the guide skid in a detachable manner in order to adapt it to different C-rail heights.

15. Guide skid according to claim 10, wherein an adapter which covers at least part of the guide skid and is fastened to the guide skid in a detachable manner in order to adapt it to different C-rail heights.

16. Guide skid for a gate drive, which is structured and arranged to be sliding in a C-profile, with two lateral openings extending over its length to accommodate a drive cord, a locking element for the coupling to and disconnecting from the drive cord and a connecting element for the gate to be moved, wherein the guide skid has a symmetrical outline and when installed in the C-profile, is structured and arranged such that all parts of the sliding guide skid are contained within the C-profile and no parts thereof project beyond a slot in the C-profile, the guide skid is provided on one phase with a continuous slot which is bridged by a bolt which forms the connecting element, and an adapter, which is arranged to cover at least part of the guide skid, is fastened to the guide skid in a detachable manner in order to adapt the guide skid to different C-profile heights.

17. Guide skid according to claim 16, wherein the locking element consists of a shiftable locking bar which arranged moving transversely to a direction of movement of the guide skid.

* * * * *